US010573268B2

(12) United States Patent
Teng

(10) Patent No.: US 10,573,268 B2
(45) Date of Patent: Feb. 25, 2020

(54) PIXEL CELL, DISPLAY SUBSTRATE, DISPLAY DEVICE, AND METHOD OF DRIVING PIXEL ELECTRODE

(71) Applicant: BOE TECHNOLOGY GROUP CO., LTD., Beijing (CN)

(72) Inventor: Wanpeng Teng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 81 days.

(21) Appl. No.: 15/552,781

(22) PCT Filed: Mar. 17, 2017

(86) PCT No.: PCT/CN2017/077079
§ 371 (c)(1),
(2) Date: Aug. 22, 2017

(87) PCT Pub. No.: WO2018/040543
PCT Pub. Date: Mar. 8, 2018

(65) Prior Publication Data

US 2018/0268772 A1 Sep. 20, 2018

(30) Foreign Application Priority Data

Sep. 1, 2016 (CN) ..... 2016 1 0801079

(51) Int. Cl.
*G09G 3/36* (2006.01)

(52) U.S. Cl.
CPC ..... *G09G 3/3696* (2013.01); *G09G 3/3648* (2013.01); *G09G 2300/043* (2013.01);
(Continued)

(58) Field of Classification Search
None
See application file for complete search history.

(56) References Cited

U.S. PATENT DOCUMENTS

2002/0154253 A1 10/2002 Cairns et al.
2005/0052366 A1 3/2005 Kim
(Continued)

FOREIGN PATENT DOCUMENTS

CN 1372242 A 10/2002
CN 1595484 A 3/2005
(Continued)

OTHER PUBLICATIONS

International Search Report and Written Opinion in PCT/CN2017/077079 dated Jun. 22, 2017, with English translation.
(Continued)

*Primary Examiner* — Andre L Matthews
(74) *Attorney, Agent, or Firm* — Womble Bond Dickinson (US) LLP

(57) ABSTRACT

A pixel cell is disclosed including a pixel electrode and a pixel driving circuit. The pixel driving circuit includes a switch module and a compensation module. The compensation module is connected with a first signal line, a second signal line, a data line and the switch module. The switch module is connected with the second signal line, the compensation module and the pixel electrode. The compensation module is operable to store a compensation voltage under control of the first signal line and further to supply the compensation voltage and a data voltage supplied via the data line to the switch module under control of the second signal line. The switch module is operable to supply the compensation voltage and the data voltage to the pixel electrode under control of the second signal line.

11 Claims, 4 Drawing Sheets

(52) U.S. Cl.
CPC ..... *G09G 2300/0819* (2013.01); *G09G 2300/0842* (2013.01); *G09G 2310/0264* (2013.01); *G09G 2310/08* (2013.01); *G09G 2320/0223* (2013.01)

(56) References Cited

U.S. PATENT DOCUMENTS

| | | | | |
|---|---|---|---|---|
| 2006/0007202 | A1 | 1/2006 | Satoh et al. | |
| 2006/0097966 | A1 | 5/2006 | Choi | |
| 2006/0284811 | A1 | 12/2006 | Huang | |
| 2012/0162175 | A1 | 6/2012 | Fan et al. | |
| 2014/0028738 | A1* | 1/2014 | Nathan ..... | G09G 3/3241 345/690 |

FOREIGN PATENT DOCUMENTS

| | | | |
|---|---|---|---|
| CN | 1804710 | A | 7/2006 |
| CN | 105405424 | A | 3/2016 |
| CN | 105702197 | A | 6/2016 |
| CN | 106297706 | A | 1/2017 |
| EP | 1655719 | A2 | 5/2006 |
| JP | 7005345752 | A | 12/2005 |
| TW | 201627971 | A | 8/2016 |

OTHER PUBLICATIONS

Search Report in Chinese Application No. 201610801079.7 dated Mar. 1, 2017, with English translation.

* cited by examiner

PIXEL CELL, DISPLAY SUBSTRATE, DISPLAY DEVICE, AND METHOD OF DRIVING PIXEL ELECTRODE

CROSS-REFERENCE TO RELATED APPLICATIONS

This application is the U.S. national phase entry of PCT/CN2017/077079, with an international filing date of Mar. 17, 2017, which claims the benefit of a priority from patent application No. 201610801079.7 filed with the Chinese Patent Office on Sep. 1, 2016, the disclosures of which are incorporated herein by reference.

TECHNICAL FIELD

The present disclosure relates to the field of display technology, and more particularly to a pixel cell, a display substrate having the pixel cell, a display device including the display substrate, and a method for driving a pixel electrode in the pixel cell.

BACKGROUND

At present, large-size display devices such as liquid crystal displays (LCDs) are popularized and become more and more welcome among the public. However, the existing large-size display devices are often unsatisfactory in terms of the quality of the displayed image in which even serious flaws may exist. An important factor with respect to the quality of the displayed image is the length of data lines in the display device. The length of the data lines increases with the size of the display device. Longer data lines have larger impedance, resulting in a large voltage drop over the data lines. This causes the charging voltage of some of the pixels in the display device to be lower than the design value. For example, for the same data line, the data signal supplied by a section of the data line far from the data driver may have a great deviation from the original data signal output from the data driver as compared to the data signal supplied by a section of the data line close to the data driver. Therefore, the pixel electrodes of some of the pixels cannot be sufficiently charged, leading to deterioration of the quality of the displayed image.

SUMMARY

Embodiments of the present disclosure provide a pixel cell, a display substrate having the pixel cell, a display device including the display substrate, and a method for driving a pixel electrode in the pixel cell to alleviate or mitigate the above-mentioned problem.

Embodiments of the disclosure provide a pixel cell comprising a pixel electrode and a pixel driving circuit. The pixel driving circuit comprises a switch module and a compensation module. The compensation module is connected to a first signal line, a second signal line, a data line and the switch module, and the switch module is connected to the second signal line, the compensation module and the pixel electrode. The compensation module is operable to store a compensation voltage under control of the first signal line, and further to supply the compensation voltage and a data voltage supplied by the data line to the switch module under control of the second signal line. The switch module is operable to supply the compensation voltage and the data voltage to the pixel electrode under control of the second signal line.

The compensation voltage stored in the compensation module may be a first voltage supplied via the first signal line, and the stored voltage can be used to compensate for the loss of the data voltage due to a voltage drop over the longer data lines. With the pixel cell provided by the embodiments of the present invention, the pixel voltage actually supplied to the pixel electrode can be numerically comparable to the sum of the compensation voltage stored in the compensation module and the data voltage supplied via the data line. In this way, the charging rate of the pixel electrode can be effectively compensated, and the image display quality of the display device can be improved.

In some embodiments, the compensation module may comprise a first switch transistor, a second switch transistor and a capacitor, and the switch module comprises a third switch transistor.

In some embodiments, a first terminal of the first switch transistor is connected to the data line, a second terminal of the first switch transistor is connected to a first terminal of the second switch transistor, a second terminal of the second switch transistor is connected to a second terminal of the capacitor, a first terminal of the capacitor is connected to a first terminal of the third switch transistor, a second terminal of the third switch transistor is connected to the pixel electrode, control terminals of the first and third switch transistors are connected to the second signal line, and a control terminal of the second switch transistor is connected to the first signal line and the first terminal of the capacitor.

In some embodiments, the compensation module further comprises a resistor, a first terminal of the resistor being connected to the first signal line, a second terminal of the resistor being electrically connected to the control terminal of the second switch transistor. By designing or selecting resistors with different resistance, the actual compensation voltage stored by the compensation module can be adjusted so that different compensation voltages can be provided for the pixels in different pixel cells.

In some embodiments, the resistor is provided in the same layer as the pixel electrode.

Another embodiment of the disclosure provides a display substrate comprising a common electrode, a pixel cell array comprising pixel cells as recited above that are arranged in an array, and a data voltage source electrically connected to data lines for supplying data voltages.

In some embodiments, the compensation module in the pixel cell comprises a first switch transistor, a second switch transistor and a capacitor. The pixel cell further comprises a resistor, a first terminal of the resistor being connected to the first signal line, a second terminal of the resistor being electrically connected to a control terminal of the second switch transistor. The resistor and the common electrode are arranged in the same layer.

In some embodiments, the first signal line and the second signal line are two adjacent gate lines in the display substrate.

In some embodiments, the resistors included in the pixel cells of the same row in the pixel cell array have the same resistance.

In some embodiments, in the pixel cells of the same column in the pixel cell array, the resistance of the resistor in the pixel cell farther from the data voltage source is smaller than the resistance of the resistor in the pixel cell closer to the data voltage source.

In some embodiments, in the pixel cells of the same column in the pixel cell array, the resistance of the resistor in a row of pixel cells is smaller than the resistance of the resistor in an adjacent preceding row of pixel cells that is closer to the data voltage source.

In some embodiments, the resistance of the resistors in an N-th row of pixel cells in the pixel cell array is (K−N+1) R/K, where K is the total number of rows in the pixel cell array, and R is the resistance of a single data line.

A further embodiment of the disclosure provides a display device which may comprise a display substrate as recited in any one of the above embodiments.

A still further embodiment of the disclosure provides a method for driving a pixel electrode in a pixel cell. The pixel cell comprises the pixel electrode and a pixel driving circuit comprising a switch module and a compensation module. The method may comprise:

receiving a first voltage supplied via a first signal line and storing a compensation voltage associated with the first voltage, by the compensation module, under control of a first signal line; and supplying, by the compensation module, to the switch module the compensation voltage and a data voltage supplied by a data line, and supplying, by the switch module, to the pixel electrode the compensation voltage and the data voltage, under control of a second signal line.

In some embodiments, the compensation module may comprise a first switch transistor, a second switch transistor and a capacitor, and the switch module comprises a third switch transistor. A first terminal of the first switch transistor is connected to the data line, a second terminal of the first switch transistor is connected to a first terminal of the second switch transistor, a second terminal of the second switch transistor is connected to a second terminal of the capacitor, a first terminal of the capacitor is connected to a first terminal of the third switch transistor, and a second terminal of the third switch transistor is connected to the pixel electrode. The method may comprise:

applying via the first signal line the first voltage to a control terminal of the second switch transistor and the first terminal of the capacitor, and storing, by the capacitor, the compensation voltage; and applying via the second signal line a second voltage to control terminals of the first and third switch transistors so that the first and third switch transistors are turned on, receiving via the second terminal of the capacitor the data voltage supplied by the data line, and supplying the compensation voltage and the data voltage to the pixel electrode.

In some embodiments, each of the first voltage and the second voltage is a pulse voltage, and the pulse of the second voltage is delayed compared to the pulse of the first voltage.

In some embodiments, the first signal line and the second signal line are two adjacent gate lines in a display device to which the pixel cell belongs.

BRIEF DESCRIPTION OF THE DRAWINGS

Embodiments of the present disclosure will be described below with reference to the accompanying drawings in more detail and by way of non-limiting example, to provide a thorough understanding of the principle and spirit of the disclosure.

DETAILED DESCRIPTION

Figure 1:
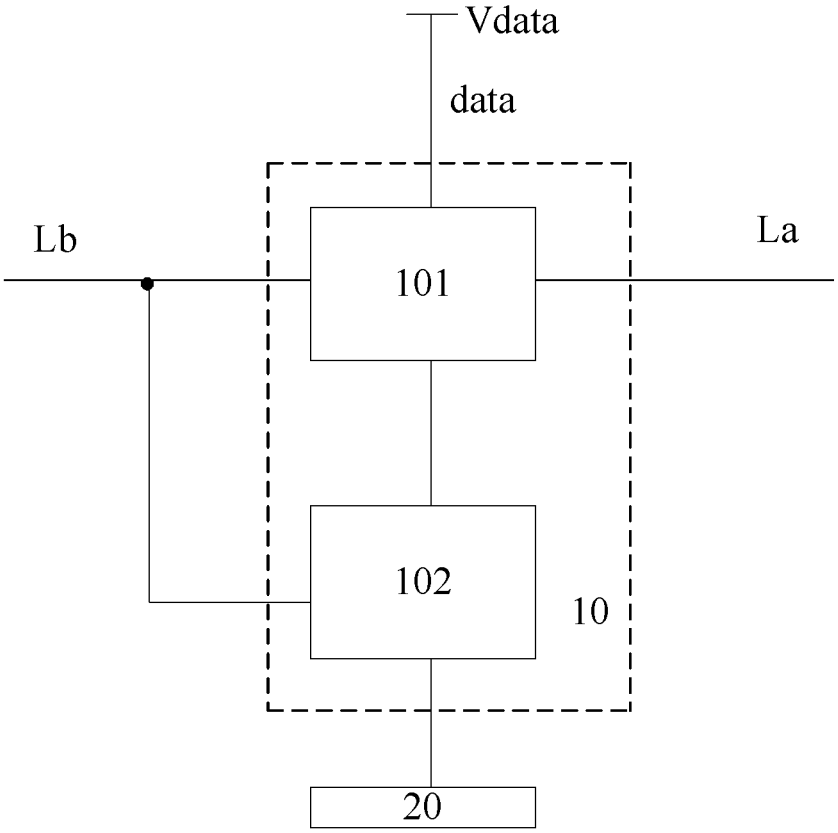
FIG. 1 schematically shows a block diagram of the structure of a pixel cell according to an embodiment of the present disclosure.

Hereinafter, specific embodiments of the present disclosure will be described in detail by way of example. It is to be understood that the embodiments of the present disclosure are not limited to the examples set forth below, and that various modifications and variations can be made by those skilled in the art using the principle or spirit of the present disclosure to obtain further embodiments having different forms. Apparently, these embodiments fall within the claimed scope of the disclosure.

Furthermore, it is to be understood that the drawings referred to herein are for the purpose of illustrating and explaining the embodiments of the disclosure, and that each unit embodied in the drawings is not necessarily identical to the actual circuit configuration. The specific connections between different units are merely illustrative of the embodiments of the disclosure, and are not to be construed as limiting the scope of the disclosure. In the case of no conflict, the technical features in the embodiments of the present disclosure may be combined with each other.

In addition, the first and second terminals of the switch transistor referred to herein are used for purposes of distinguishing between both terminals of the switch transistor other than the control terminal (gate), one of which is referred to as the first terminal and the other one of which is referred to as the second terminal. The first and second terminals of the switch transistor are symmetrical so that the first and second terminals are interchangeable. It is also to be understood that the term "connect" or "electrically connect" as mentioned herein may mean that two elements are directly connected, or that the two elements are indirectly connected (i.e., there may be other element(s) therebetween).

Figure 2:
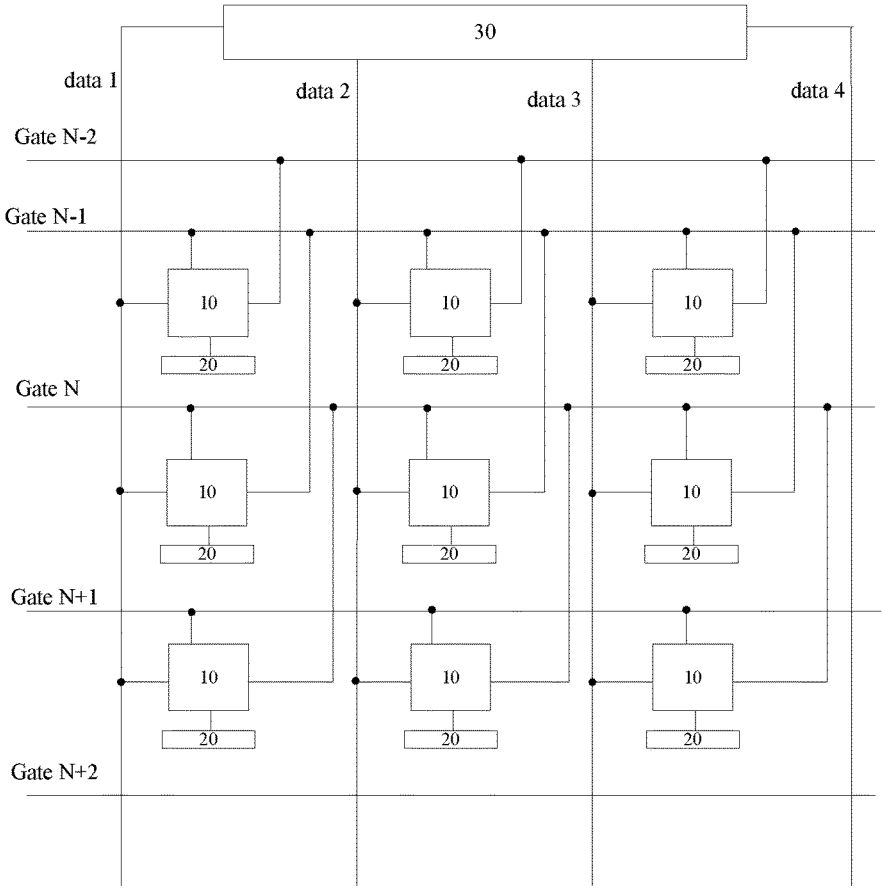
FIG. 2 schematically shows a block diagram of the structure of a display substrate according to an embodiment of the present disclosure.

Reference is made to FIGS. 1 and 2, wherein FIG. 1 schematically shows a block diagram of a pixel cell according to an embodiment of the present disclosure, and FIG. 2 shows a pixel cell array composed of a plurality of such pixel cells. In the embodiment shown in FIG. 1, a single pixel cell may include a pixel electrode 20 and a pixel driving circuit 10 which may include a switch module 102 and a compensation module 101. The compensation module 101 is connected to a first signal line La, a second signal line Lb, a data line "data" and the switch module 102. The switch module 102 is connected to the second signal line Lb, the compensation module 101 and the pixel electrode 20. The compensation module 101 is operable to store a compensation voltage under control of the first signal line La, and further to supply the compensation voltage and a data voltage Vdata supplied by the data line "data" to the switch module 102 under control of the second signal line Lb. The switch module 102 is operable to supply the compensation voltage and the data voltage Vdata to the pixel electrode 20 under control of the second signal line Lb.

Display devices such as LCDs typically include a plurality of pixel cells arranged in an array. The pixel cell provided by the embodiments of the present disclosure may be any one of the pixel cells of a display device. Moreover, the pixel driving circuit 10 in the pixel cell is particularly applicable to the pixel cell of the display device which is far from the data voltage source (data driver). For a typical LCD display device, due to the existence of a certain voltage drop on the data line, the pixel electrodes in different pixel cells connected to the same data line may actually receive different data voltages from the data voltage source. There may be a large attenuation in the data voltage signals received by the pixel electrodes in the pixel cells far from the data voltage source, such that the driving voltages of these pixel electrodes may deviate greatly from the design value (expected value), resulting in insufficient charging of the pixel electrodes. For the LCD display devices, this may mean that an expected electric field cannot be established in some display areas, and accordingly, a portion of the liquid crystal molecules may not be deflected at a desired angle, or there may even be a large error in the deflection direction. Thus, the image quality of the display device is adversely affected. However, for the pixel cell provided by the embodiments of the present disclosure, the compensation module therein may store the compensation voltage under control of the first signal line. For example, the compensation module may use a first voltage supplied via the first signal line as the compensation voltage. Further, the compensation module may also supply the compensation voltage and a data voltage supplied by the data line to the pixel electrode via the switch module under control of the second signal line. Thus, for the pixel cell provided by the embodiments of the present disclosure, the pixel voltage actually supplied to the pixel electrode can be numerically approximate to the sum of the compensation voltage stored in the compensation module and the data voltage supplied via the data line. In other words, the first voltage (compensation voltage) supplied via the first signal line compensates for the data voltage loss due to the voltage drop over the long data line, so that the charging rate of the pixel electrode can be effectively compensated, facilitating improvement of the image display quality of the display device.

Figure 3:
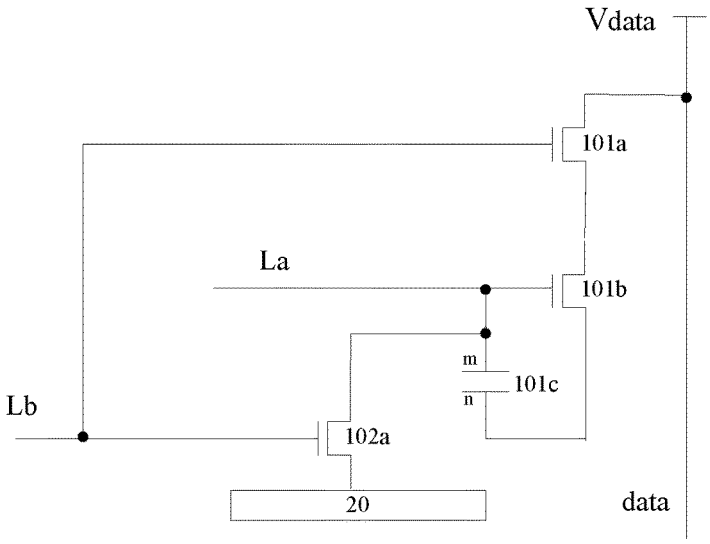
FIG. 3 schematically shows a specific circuit of a pixel driving circuit in a pixel cell according to an embodiment of the present disclosure.

FIG. 3 schematically shows a specific circuit configuration of the pixel driving circuit 10 in the pixel cell according to an embodiment of the present disclosure. In this embodiment, the compensation module 101 may include a first switch transistor 101*a*, a second switch transistor 101*b* and a capacitor 101*c*, and the switch module 102 may include a third switch transistor 102*a*.

Figure 4:
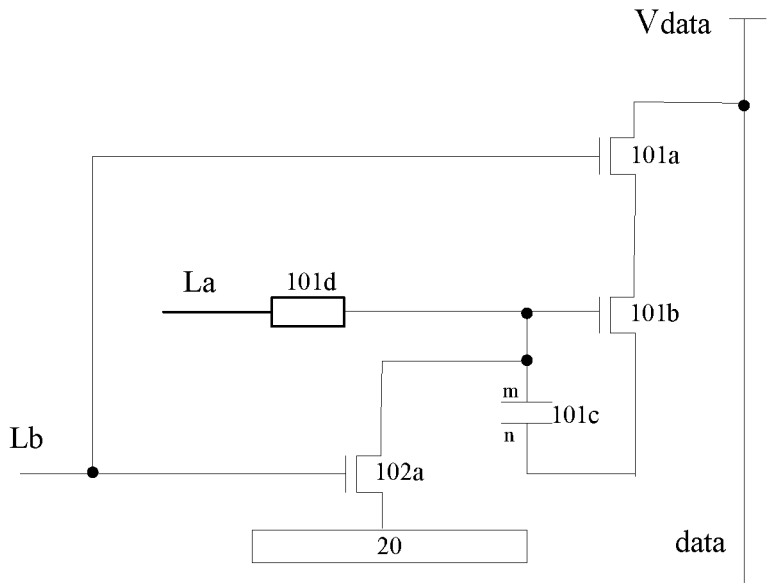
FIG. 4 schematically shows a specific circuit of a pixel driving circuit in a pixel cell according to another embodiment of the present disclosure.

As shown in FIG. 4, in another embodiment, the compensation module 101 may include a resistor 101*d*, in addition to the first switch transistor 101*a*, the second switch transistor 101*b* and the capacitor 101*c*. A first terminal of the resistor 101*d* is connected to the first signal line La, and a second terminal of the resistor 101*d* is electrically connected to a control terminal of the second switch transistor 101*b*. It can be seen from the embodiments of FIGS. 3 and 4 that a first voltage signal supplied via the first signal line La can be supplied to the control terminal of the second switch transistor 101*b* while being supplied to a first terminal m of the capacitor 101*c*, and that a second voltage signal supplied via the second signal line Lb may be supplied to control terminals of the first switch transistor 101*a* and the third switch transistor 102*a*. Therefore, the first switch transistor 101*a* and the third switch transistor 102*a* can be simultaneously turned on or off under control of the second signal line Lb, the second switch transistor 101*b* can be turned on or off under control of the first signal line La, and the capacitor 101*c* can receive and store the first voltage supplied via the first signal line La as the compensation voltage. In addition, with respect to the embodiment shown in FIG. 4, since the compensation module has the resistor 101*d*, the magnitude of the compensation voltage stored in the compensation module can be adjusted by selecting or adjusting the resistance of the resistor 101*d*.

It should be appreciated that the first switch transistor 101*a*, the second switch transistor 101*b* and the third switch transistor 102*a* may be N-type transistors or P-type transistors (including, but not limited to, N-type thin film transistors and P-type thin film transistors), depending on the voltage signals supplied via the first signal line La and the second signal line Lb and on the data voltage Vdata supplied via the data line. Although the switch element in the compensation module is schematically shown in FIGS. 3 and 4 as including the first switch transistor 101*a*, the second switch transistor 101*b*, and the third switch transistor 102*a*, the compensation module or the switch module may further include additional switch elements that may play a supporting role. In addition, the pixel driving circuit 10 provided by the embodiments of the present disclosure is not limited to including only one capacitor 101*c*. The compensation module 101 or the switch module 102 may include additional capacitors that may function to optimize the circuit (e.g., a regulated or filtering capacitor).

Referring again to FIG. 4, according to an embodiment of the present disclosure, a first terminal of the first switch transistor 101*a* is connected to the data line "data", a second terminal of the first switch transistor 101*a* is connected to a first terminal of the second switch transistor 101*b*, a second terminal of the second switch transistor 101*b* is connected to a second terminal n of the capacitor 101*c*, a first terminal m of the capacitor 101*c* is connected to a first terminal of the third switch transistor 102*a*, a second terminal of the third switch transistor 102*a* is connected to the pixel electrode 20, the control terminals of the first switch transistor 101*a* and the third switch transistor 102*a* are connected to the second signal line Lb, and the control terminal of the second switch transistor 101*b* is connected to the second terminal of the resistor 101*d* and the first terminal m of the capacitor 101*c*. In some embodiments, the first signal line La and the second signal line Lb may be two adjacent gate lines in the display panel of the display device. Alternatively, there may be other gate lines spaced between the first signal line and the second signal line. Thus, the voltage signals supplied via the first signal line and the second signal line may be voltage pulse signals having a time difference.

For the embodiment shown in FIG. 4, the resistor 101*d* may be provided in the same layer as the pixel electrode 20. The resistor 101*d* may be made of a transparent conductive material such as indium tin oxide (ITO). This way, the resistor 101*d* and the pixel electrode 20 can be fabricated in the same layer by a one-time patterning process, thereby simplifying the production process of the display panel of the display device. In addition, due to a large block resistivity of the indium tin oxide (ITO), it is possible to realize a single qualified resistor 101*d* with a small area so as to minimize the influence on the pixel aperture ratio of the display device.

In the following, the principle and process of compensating the driving voltage supplied to the pixel electrode by the compensation module in the pixel cell according to an embodiment of the present disclosure will be described by way of example with reference to FIGS. 5 and 3. Description is made below on the assumption that the switch transistors in FIG. 3 are N-type thin film transistors, for example.

Figure 5:
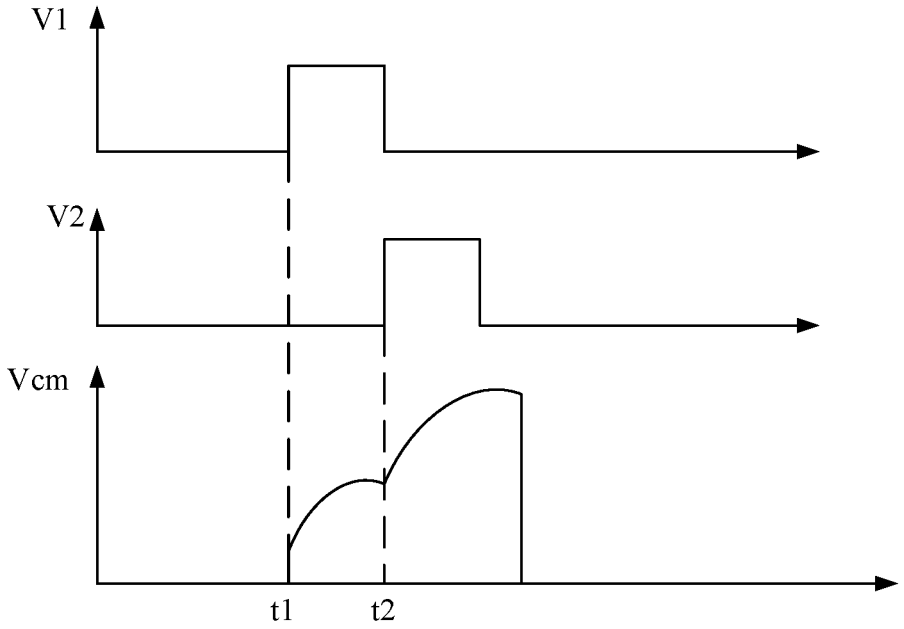
FIG. 5 schematically shows a signal timing diagram of a pixel driving circuit in a pixel cell according to an embodiment of the present disclosure.

As shown in FIG. 5, a first voltage V1 is supplied via the first signal line La at time t1. Thus, the first voltage V1 is applied to the control terminal of the second switch transistor 101*b* so that the second switch transistor 101*b* is turned on, and the voltage V1 charges the capacitor 101*c* via its first terminal m. Therefore, from the time t1 on, the potential Vcm of the first terminal m of the capacitor 101*c* can be raised to approximately equal to the first voltage V1. At this time, both the second switch transistor 101*b* and the third switch transistor 102*a* are turned off, and the capacitor 101*c* can maintain its potential at the first terminal m approximately equal to the first voltage V1 for a certain period of time. At the time t2, that is, at the end of the pulse of the first voltage V1, the pulse of a second voltage V2 is supplied to the control terminals of the first switch transistor 101*a* and the third switch transistor 102*a* via the second signal line Lb such that the first switch The transistor 101*a* and the third switch transistor 102*a* are turned on. At this time, although the pulse of the first voltage V1 does not exist, the potential of the control terminal of the second switch transistor 101*b* is maintained approximately equal to the first voltage V1 due to the potential holding function of the capacitor 101*c*, so that the second switch transistor 101*b* is turned on. Therefore, from the time t2 on, the first switch transistor 101*a*, the second switch transistor 101*b*, and the third switch transistor 102*a* are all turned on. A data voltage Vdata is applied to the second terminal n of the capacitor 101*c* via the first switch transistor 101*a* and the second switch transistor 101*b*. Accordingly, due to a self-boosting effect of the capacitor, the potential Vcm of the first terminal m of the capacitor 101*c* is increased by the data voltage Vdata on the basis of approximately the voltage level of the first voltage V1, such that the potential Vcm of the first terminal m of the capacitor 101*c* is self-boosted to Vdata+V1. Since the third switch transistor is turned on, Vcm is supplied to the pixel electrode 20. Thus, from the time t2 on, the third switch transistor 102*a* may supply the first voltage V1 and the data voltage Vdata to the pixel electrode 20, i.e., the voltage actually applied to the pixel electrode 20 is approximately equal to the sum of the first voltage V1 and the data voltage Vdata. As can be seen from FIG. 5, from the time t2 on, the potential Vcm of the first terminal m of the capacitor 101*c* is significantly increased.

Another embodiment of the present disclosure provides a display substrate which may comprise the pixel cell as described above in any of the embodiments of the present disclosure. Referring again to FIG. 2, the display substrate may include an array of pixel cells consisting of a plurality of pixel cells, respective data lines (e.g., data 1, data 2, data 3, data 4) electrically connected to respective columns of pixel cells, a data voltage source 30 electrically connected to the data lines for supplying data voltages, and a common electrode (not shown in FIG. 1). It is to be understood that the display substrate may be an array substrate of a display device.

The pixel cell in the display substrate may be the pixel cell as provided in any of the embodiments described above. For example, in one embodiment, the compensation module in the pixel cell may include a first switch transistor, a second switch transistor and a capacitor, and the pixel cell may further include a resistor, with a first terminal of the resistor being connected to a first signal line, a second terminal of the resistor being electrically connected to a control terminal of the second switch transistor. The resistor and the common electrode may be provided in the same layer. In this way, the compensation voltage supplied by the compensation module can be adjusted by way of the resistor. Also, the common electrode of the display substrate and the resistor in each pixel cell can be fabricated by a one-time patterning process, facilitating simplification of the fabrication process of the display substrate.

The first signal line and the second signal line may be different gate lines (e.g., Gate N−2, Gate N−1, Gate N, Gate N+1, or Gate N+2) in the display substrate for supplying a gate drive signal. In one embodiment, the first signal line and the second signal line are two adjacent gate lines (e.g., Gate N and Gate N−1) in the display substrate. Thus, the voltage signals supplied by the first signal line and the second signal line may be voltage pulse signals having a time difference.

In an embodiment, the resistors included in the pixel cells of the same row in the pixel cell array have the same resistance. For example, for the embodiment shown in FIG. 1, the resistors included in the pixel driving circuits 10 in the N-th row of pixel cells may have the same resistance, and the resistors included in the pixel driving circuits 10 in the (N−1)-th row of pixel cells may have the same resistance. Since the distance from the pixel electrodes in the same row of pixel cells to the data voltage source 30 can be regarded as approximately equal, the lengths of the data lines between these pixel electrodes and the data voltage source 30 are approximately the same, and the amounts of data voltage to be compensated for are also approximately the same. Thus, the resistance of the resistors in the pixel driving circuits 10 in the same row of pixel cells can be set equal to each other.

It can be understood that in the pixel cell array shown in FIG. 1 the data voltage at the pixel cell farther from the data voltage source 30 has a greater voltage drop as compared with the pixel cell closer to the data voltage source 30. Thus, the pixel electrode in the pixel cell farther from the data voltage source 30 requires a larger compensation voltage. Accordingly, in some embodiments, in the pixel cells of the same column in the pixel cell array, the resistance of the resistor in the pixel cell farther from the data voltage source 30 is greater than the resistance of the resistor in the pixel cell closer to the data voltage source 30.

Further, in some embodiments, in the pixel cells of the same column in the pixel cell array, the resistance of the resistors in a row of pixel cells is greater than the resistance of the resistors in an adjacent preceding row of pixel cells that is closer to the data source 30. That is, the resistance of the resistors in the pixel cells in the pixel cell array gradually decreases as the distance from the pixel cells to the data voltage source 30 increases. In this way, it is possible to allow the pixel electrodes in the same column of pixel cells to receive an approximately uniform driving voltage, thereby realizing accurate compensation of the charging voltage of the pixel electrodes in respective rows of pixel cells, and further facilitating improvement of the image quality of the display device.

In some embodiments, the resistance of the resistors in the N-th row of pixel cells in the array of pixel cells is (K−N+1)R/K, where K is the total number of rows of the pixel cell array and R is the resistance of a single data line.

Another embodiment of the present disclosure provides a display device that may include a display substrate as provided in any one of the preceding embodiments. The display device can be any product or component with display functionality such as a mobile phone, a tablet, a TV, a monitor, a notebook computer, a digital photo frame, a navigator, etc. Other essential components of the display device are those that have been understood by those of ordinary skill in the art, which are omitted here for simplicity and are not to be construed as limiting the present disclosure.

Figure 6:
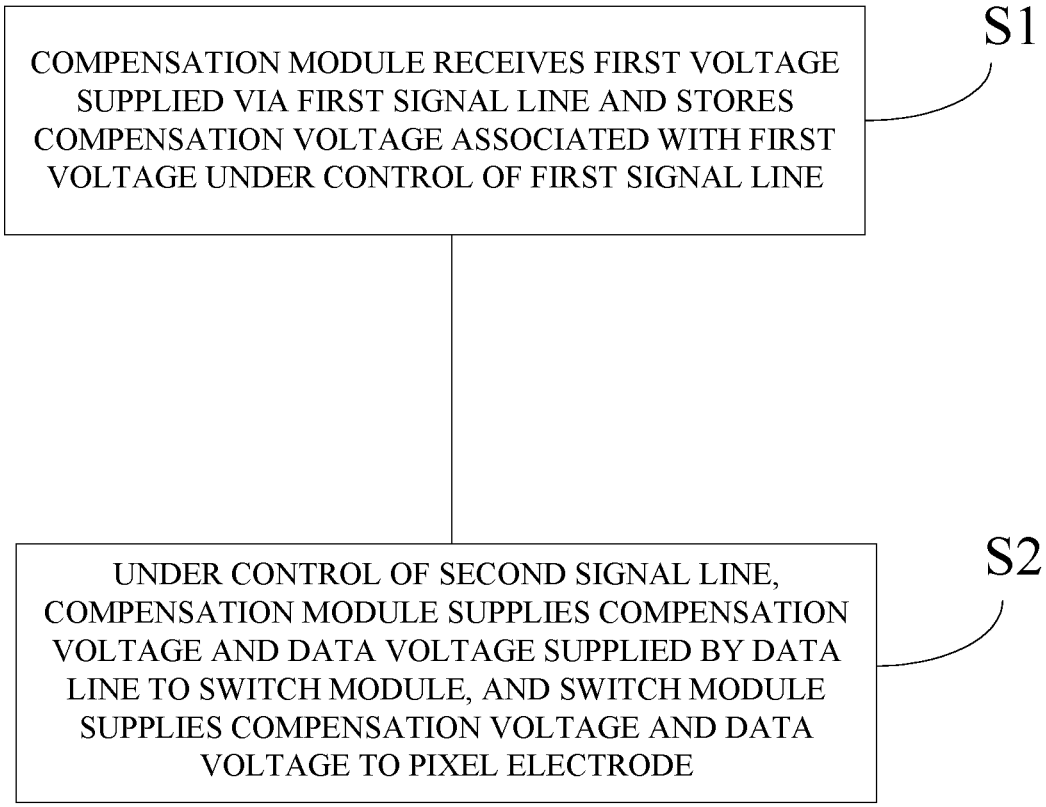
FIG. 6 schematically shows a flow diagram of a method for driving a pixel electrode in a pixel cell according to an embodiment of the present disclosure.

According to still another embodiment of the present disclosure, a method is provided for driving a pixel electrode in a pixel cell including the pixel electrode and a pixel driving circuit including a switch module and a compensation module. As shown in FIG. 6, the method may include the following steps.

At S1, under the control of a first signal line, the compensation module receives a first voltage supplied via the first signal line and stores a compensation voltage associated with the first voltage.

At S2, under the control of a second signal line, the compensation module supplies the compensation voltage and a data voltage supplied via a data line to the switch module, and the switch module supplies the compensation voltage and the data voltage to the pixel electrode.

In an embodiment, the compensation module may include a first switch transistor, a second switch transistor and a capacitor, and the switch module includes a third switch transistor. A first terminal of the first switch transistor is connected to the data line, a second terminal of the first switch transistor is connected to a second terminal of the second switch transistor, a second terminal of the second switch transistor is connected to a second terminal of the capacitor, a first terminal of the capacitor is connected to a first terminal of the third switch transistor, and a second terminal of the third switch transistor is connected to the pixel electrode. The method of driving the pixel electrode in the pixel cell may include:

applying via the first signal line the first voltage to a control terminal of the second switch transistor and the first terminal of the capacitor, and storing, by the capacitor, the compensation voltage; and applying via the second signal line a second voltage to control terminals of the first and third switch transistors so that the first and third switch transistors are turned on, receiving, by the second terminal of the capacitor, the data voltage supplied by the data line, and supplying the compensation voltage and the data voltage to the pixel electrode.

In some embodiments, both the first voltage and the second voltage are pulse voltages, and the pulse of the second voltage is delayed compared to the pulse of the first voltage.

In some embodiments, the first signal line and the second signal line may be two adjacent gate lines in the display device to which the pixel cell belongs.

While the embodiments of the present disclosure have been described in detail with reference to the accompanying drawings, it should be noted that the above-described embodiments are intended to illustrate and not limit the disclosure, and that one skilled in the art will be able to devise many alternative embodiments without departing from the scope of the appended claims. In the claims, the word "comprise" or "comprising" does not exclude the presence of elements or steps other than those recited in the claims. The word "a" or "an" preceding the element does not exclude the presence of a plurality of such elements. The mere fact that certain features are recited in mutually different dependent claims does not mean that a combination of these features cannot be used to advantage.

What is claimed is:

1. A display substrate comprising:

a common electrode;

a pixel cell array comprising pixel cells arranged in an array; and a data voltage source electrically connected to data lines for supplying data voltages, wherein each pixel cell comprises a pixel electrode and a pixel driving circuit, the pixel driving circuit comprising a switch module and a compensation module, the compensation module being directly connected to a first signal line, a second signal line, a data line and the switch module, the switch module being connected to the second signal line, the compensation module and the pixel electrode, the compensation module being operable to store a compensation voltage under control of the first signal line, and further to supply the compensation voltage and a data voltage supplied by the data line to the switch module under control of the second signal line, the switch module being operable to supply the compensation voltage and the data voltage to the pixel electrode under control of the second signal line, wherein the compensation module in the pixel cell comprises a first switch transistor, a second switch transistor and a capacitor, wherein the pixel cell further comprises a resistor, a first terminal of the resistor being directly connected to the first signal line, a second terminal of the resistor being directly connected to a control terminal of the second switch transistor, and wherein the resistor and the common electrode are arranged in the same layer, and wherein the resistors included in the pixel cells of the same row in the pixel cell array have the same resistance.

2. The display substrate of claim 1, wherein the first signal line and the second signal line are two adjacent gate lines in the display substrate.

3. The display substrate of claim 1, wherein in the pixel cells of the same column in the pixel cell array the resistance of the resistor in the pixel cell farther from the data voltage source is smaller than the resistance of the resistor in the pixel cell closer to the data voltage source.

4. The display substrate of claim 3, wherein in the pixel cells of the same column in the pixel cell array the resistance of the resistor in a row of pixel cells is smaller than the resistance of the resistor in an adjacent preceding row of pixel cells that is closer to the data voltage source.

5. The display substrate of claim 4, wherein the resistance of the resistors in an N-th row of pixel cells in the pixel cell array is $(K-N+1)R/K$, wherein K is the total number of rows in the pixel cell array, and R is the resistance of a single data line.

6. A display device comprising a display substrate as recited in claim 1.

7. A display device comprising a display substrate as recited in claim 2.

8. A display device comprising a display substrate as recited in claim 3.

9. A method for driving a pixel electrode in a pixel cell, the pixel cell comprising the pixel electrode and a pixel driving circuit comprising a switch module and a compensation module, the method comprising:

receiving a first voltage supplied via a first signal line and storing a compensation voltage associated with the first voltage, by the compensation module, under control of a first signal line; and supplying, by the compensation module, to the switch module the compensation voltage and a data voltage supplied by a data line, and supplying, by the switch module, to the pixel electrode the compensation voltage and the data voltage, under control of a second signal line, wherein the compensation module comprises a first switch transistor, a second switch transistor and a capacitor, wherein the switch module comprises a third switch transistor, a first terminal of the first switch transistor being directly connected to the data line, a second terminal of the first switch transistor being directly connected to a first terminal of the second switch transistor, a second terminal of the second switch transistor being directly connected to a second terminal of the capacitor, a first terminal of the capacitor being directly connected to a first terminal of the third switch transistor, a second terminal of the third switch transistor being directly connected to the pixel electrode, wherein the receiving comprises:

receiving, via a control terminal of the second switch transistor and the first terminal of the capacitor, the first voltage from the first signal line, wherein the storing comprises storing, by the capacitor, the compensation voltage, wherein the supplying by the compensation module and the supplying by the switch module comprise: applying via the second signal line a second voltage to control terminals of the first and third switch transistors so that the first and third switch transistors are turned on, receiving via the second terminal of the capacitor the data voltage supplied by the data line, and supplying the compensation voltage and the data voltage to the pixel electrode, and wherein the pixel cell further comprises a resistor, a first terminal of the resistor being directly connected to the first signal line, a second terminal of the resistor being directly connected to a control terminal of the second switch transistor, and wherein the resistor and the common electrode are arranged in the same layer, and wherein the resistors included in the pixel cells of the same row in the pixel cell array have the same resistance.

10. The method of claim 9, wherein each of the first voltage and the second voltage is a pulse voltage, and wherein the pulse of the second voltage is delayed compared to the pulse of the first voltage.

11. The method of claim 10, wherein the first signal line and the second signal line are two adjacent gate lines in a display device to which the pixel cell belongs.

* * * * *